US005271615A

United States Patent [19]

Kawauchi et al.

[11] Patent Number: 5,271,615

[45] Date of Patent: * Dec. 21, 1993

[54] SHEET FEEDING DEVICE AND METHOD FOR FEEDING THIN SHEETS WITH NO BUCKLING

[75] Inventors: Masataka Kawauchi, Ishioka; Eisaku Saiki, Niihari, both of Japan

[73] Assignee: Hitachi, Ltd., Japan

[ * ] Notice: The portion of the term of this patent subsequent to Apr. 21, 2009 has been disclaimed.

[21] Appl. No.: 870,830

[22] Filed: Apr. 20, 1992

Related U.S. Application Data

[63] Continuation of Ser. No. 610,318, Nov. 8, 1990, Pat. No. 5,106,073, which is a continuation of Ser. No. 131,272, Dec. 9, 1987, abandoned, which is a continuation of Ser. No. 642,259, Aug. 20, 1984, abandoned, which is a continuation-in-part of Ser. No. 407,902, Aug. 13, 1982, abandoned.

[30] Foreign Application Priority Data

Aug. 21, 1981 [JP] Japan ..... 56-130087

[51] Int. Cl.[5] ..... B65H 3/46

[52] U.S. Cl. ..... 271/121; 271/126

[58] Field of Search ..... 271/121, 122, 124, 125, 271/126, 127, 263

[56] References Cited

U.S. PATENT DOCUMENTS

| | | | |
|---|---|---|---|
| 650,410 | 5/1900 | Morin | 271/121 |
| 2,104,630 | 1/1938 | Zahn | 271/122 |
| 2,140,171 | 12/1938 | Rouan | 271/125 |
| 2,887,316 | 5/1959 | Tobey | 271/125 |
| 3,804,400 | 3/1972 | Hunt et al. | 271/121 X |
| 3,961,786 | 6/1976 | Yanker | 271/122 |
| 3,981,497 | 9/1976 | Feinstein, Jr. et al. | 271/126 |
| 4,032,135 | 6/1977 | Ruenzi | 271/124 |
| 4,061,328 | 12/1977 | Fujimoto et al. | 271/121 X |
| 4,368,880 | 1/1983 | Shimizu | 271/121 |
| 4,458,890 | 7/1984 | Kawazu | 271/121 X |
| 5,106,073 | 4/1992 | Kawauchi et al. | 271/121 |

*Primary Examiner*—Robert P. Olszewski
*Assistant Examiner*—Boris Milef
*Attorney, Agent, or Firm*—Evenson, McKeown, Edwards & Lenahan

[57] ABSTRACT

A sheet feeding device comprising a plurality of pickup rollers for exerting a feeding force P (gf) on thin sheets which have ream weights K (kg) less than 55 kg and one or more friction rollers for offering resistance to the thin sheets fed by the pickup rollers. A distance L (mm), in a feeding direction, between the pickup rollers and the friction rollers is set in a range defined by the relationship $$L < 0.83\, K^{\frac{3}{2}} / \sqrt{P}$$

so as to enable a feeding of the thin sheets with no buckling.

11 Claims, 7 Drawing Sheets

SHEET FEEDING DEVICE AND METHOD FOR FEEDING THIN SHEETS WITH NO BUCKLING

This application is a continuation of application Ser. No. 07/610,318, filed on Nov. 8, 1990, now U.S. Pat. No. 5,106,073, which is a continuation of Ser. No. 07/131,272, filed Dec. 9, 1987, now abandoned, which is a continuation of application Ser. No. 06/642,259, filed Aug. 20, 1984, now abandoned, which is a continuation-in-part of application Ser. No. 06/407,902, filed Aug. 13, 1982, now abandoned.

BACKGROUND OF THE INVENTION

This invention relates to sheet feeding devices suitable for use with optical character readout apparatus, printers, copy machines, etc., and more particularly, to a sheet feeding device capable of stably carrying out separation and feeding of sheets of less than 55 kg paper.

In this specification, the term "55 kg paper" refers to sheet having a characteristic such that, if the sheets have a size 788 mm × 1091 mm, the sheets have a weight of 55 kgf in 1,000 sheets.

Recently, there has been a demand to carry out rationalization of office work and various kinds of office automation equipment have been developed. The majority of office work is accounted for by paper work consisting of making and filing documents. To rationalize such work, it is important that input devices for reading the information recorded on a paper and output devices for printing out the results of calculation have their performance improved. For example, optical character read-out apparatus and various printers have important functions as input and output devices for office work. Meanwhile, in this type of work, accumulation and transfer of information relies on sheets as a medium in many cases, and in practice the volume of sheets used in office work is increasing. Consequently, to use sheets of a small thickness for office work is an important requirement for conserving natural resources and reducing office space. However, automatic sheet feeding devices of the prior art are only able to handle sheets of a large thickness such as sheets of over 55 kg paper. When the sheets used are less thick, the rigidity of the sheets is reduced and difficulties are experienced in handling the sheets, resulting in double feeding or sheet jamming. Thus, the aim of achieving rationalization of office work is defeated.

For example, an optical character read-out apparatus can generally only handle sheets of relatively high thickness and rigidity which are of 70–135 kg paper.

Presently, there are two types of practical processes for individually separating a sheet from a stack of sheets stored in a hopper and feeding the separated sheets. One proposed process relies friction when feeding thin sheets, the following problems arise.

To attract a sheet by a vacuum pump, thin sheets are air-permeable and not only one sheet but two or more sheets are attracted by the force of vacuum, thereby causing double feeding to occur. A process is available which relies on subatmospheric pressure in attracting sheets for separating one sheet from the rest of the sheets. However, this process suffers a disadvantage in that a large capacity blower is required and the apparatus for working the process is relatively large. Additionally, the blower generates considerable noise, so that it is not possible to reduce the size and noise level.

Meanwhile a frictional separation mechanism used in many copying apparatus, printers, etc., also have the problems of sheet jamming, sheet bending and wrinkle formation due to a lack of rigidity in the processed sheets.

An object of the invention is to provide a sheet feeding device of high reliability capable of avoiding buckling or jamming of thin sheets of for example, less 55 kg in ream weight, when being fed to a subsequent processing station.

Another object of the invention is to provide a sheet feeding device capable of avoiding a skew movement of the thin sheet.

A sheet feeding device according to the present invention comprises feeding means for exerting a feeding force P (gf) on the uppermost sheet and separating means for offering resistance to the sheets fed by the feeding means. A distance L (mm), in the feeding direction, between a point at which the feeding means exerts the feeding force on the sheets and a point at which the separating means exerts a separating force on the sheets is set in a range defined by the following formula so that no buckling of the thin sheets is produced:

$$L < 0.83\, K^{\frac{3}{2}} / \sqrt{P}\,.$$

In another aspect of the invention, the feeding means comprises a plurality of feeding members separated from each other in a direction perpendicular to the feeding direction so as to avoid bending and a skewing movement of the thin sheets.

DETAILED DESCRIPTION

Before stating preferred embodiments of the invention, the sheet feeding device of the prior art will be described, by referring to the accompanying drawings.

Figure 1A:
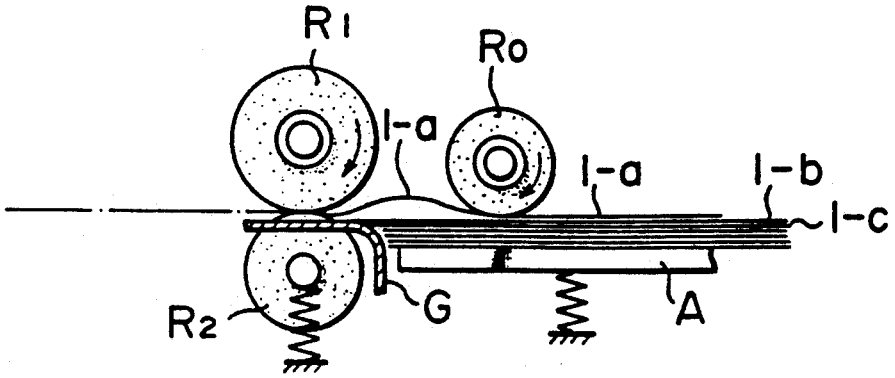
FIG. 1(a) PRIOR ART
FIGS. 1(*a*) and 1(*b*) are views showing the manner in which sheets are fed by a sheet feeding device of the prior art.
Figure 1B:
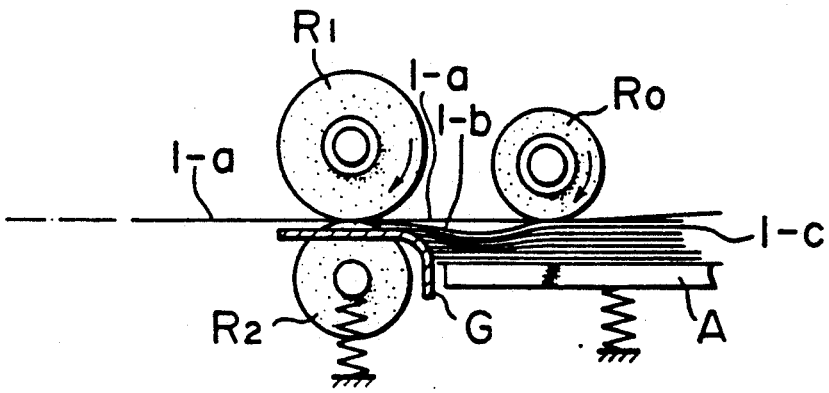
FIG. 1(b) PRIOR ART

A frictional separation mechanism is proposed in U.S. Pat. No. 3,981,497 wherein, as shown in FIG. 1(*a*), pickup rollers R0 are in light pressing engagement with the uppermost sheet 1-a of a stack of sheets piled on a sheet feed tray A. The sheets fed by the pickup rollers R0 are separated one from another by separating means or a pair of rollers R1 and R2 located downstream of the pickup roller R0.

In this construction, the uppermost sheet 1-a is fed by the pickup rollers R0 toward the supply roller R1. However, when the sheets handled are thin, the problem shown in FIGS. 1(*a*) and 1(*b*) is raised.

More specifically, the supply roller R1 rotates clockwise as shown in FIG. 1(*a*), but the friction member R2, in pressing engagement with the supply roller R1, remains stationary or rotates in the reverse direction to separate one sheet from another sheet as they are introduced between the two rollers R1 and R2. Thus, the sheet 1-a, fed by the pickup rollers R0 and moved leftwardly in FIG. 1(*a*), moves in sliding movement on a guide member G. However, if the leading end of the sheet 1-a abuts against the guide member G, its movement is interfered with. When the sheet is thick and has high rigidity, the rigidity of the sheet 1-a might overcome the frictional force of the friction member R2 to allow the leading end of the sheet 1-a to move leftwardly. However, when the sheet 1-a is thin and has low rigidity, there is an interference in the the movement of the sheet 1-a because the frictional force of the friction member R2 is too high for the leading end of the sheet 1-a to move forwardly. That is, the first sheet 1-a buckles as shown, and if the pickup rollers R0 continue rotating, only the trailing end portion of the first sheet 1-a is moved forwardly until the first sheet 1-a is warped between the pickup rollers R0 and the supply roller R1, resulting in a sheet jamming. If the first sheet 1-a buckles or jams, the feeding force of the pickup rollers R0 is exerted on the second sheet 1-b with which the pickup rollers R0 are brought into contact, so that jamming of the sheets continuously occurs.

Also, the first sheet 1-a exerts a frictional force on the second sheet 1-b to cause same to move leftwardly. Thus the first sheet 1-a ceases to function as a guide for the second sheet 1-b which buckles in the same manner as the first sheet 1-a, thereby intensifying the jamming phenomenon.

FIG. 1(*b*) shows the manner in which the first sheet 1-a has avoided being brought to the condition shown in FIG. 1(*a*) and is held between the supply roller R1 and the friction member R2 to be conveyed forwardly. The first sheet 1-a is kept flat without being bent between rollers R0 and R1 as shown. However, the second sheet 1-b has a feeding force exerted thereon as friction occurs between it and the first sheet 1-a, but the leading end portion is held between an underside of the first sheet 1-a and the friction member R2 and is unable to move. As a result, the second sheet 1-b may undergo deformation under the first sheet 1-a and develop buckling, until finally it may be bent near its leading end portion and develop jamming. There is a possibility that a similar phenomenon will occur with regard to the third sheet 1-c.

The foregoing description refers to separating one sheet at a time from a stack of sheets to convey same forwardly. In printers, the need arises to use a sheet unit comprising a plurality of carbon or noncarbon sheets. In this case, sheet units each comprising a plurality of sheets bonded to one another as by pasting at the leading end portions have to be fed one after another. For this purpose sheets of about 35 kg paper are generally used. Thus when the first sheet of the uppermost sheet unit is fed by pickup rollers, the second and the following sheets of the top sheet unit may not be moved by the friction between underlying sheets, so that the first sheet of the sheet unit may only be fed. As a result, a situation similar to that shown in FIG. 1(*a*) may occur thereby causing a sheet jamming to occur.

All the phenomena described above are attributed to the fact that the sheets small in thickness and low in rigidity are liable to buckle.

Figure 2:
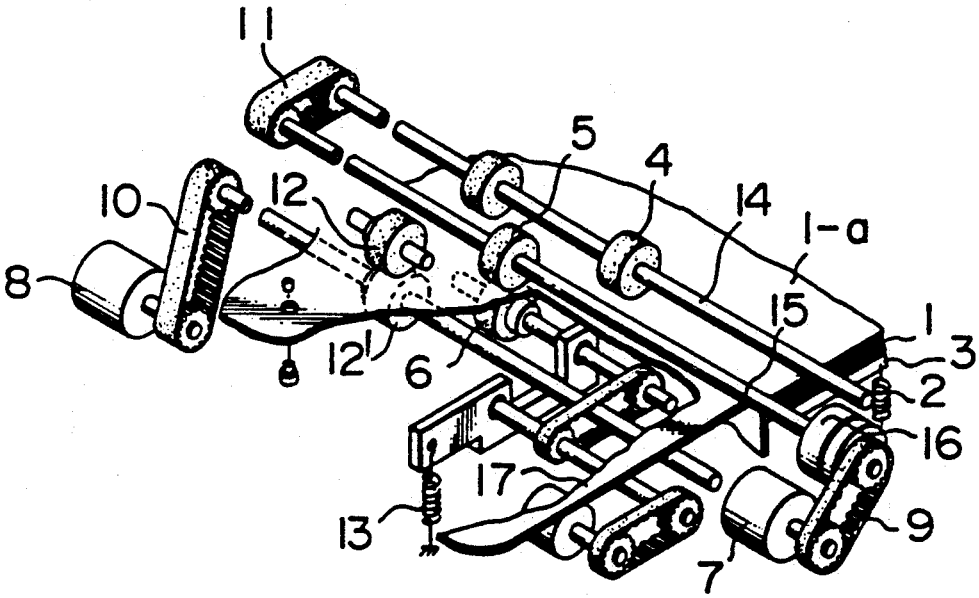
FIG. 2 is a partially schematic perspective view of the sheet feeding device in its entirety according to the invention.

As shown in FIG. 2, in a sheet feeding device according to the invention, a stack of sheets 1 is piled on a sheet feed tray 3 through springs 2 with the sheets being individually into one sheet at a time separated into one sheet at a time by pickup rollers 4, supply roller 5 and a friction member 6. The top sheet 1-a of the stack of sheets 1 is in light contact with the pickup rollers 4, and the rollers 4, 5 as well as a roller 12 connected to motors 7, 8 through belts 9, 10 and 11 are rotated by the motors in the same direction to feed the sheet 1-a.

Upon the motor 7 being actuated, the pickup rollers 4 and supply roller 5 cooperate with each other to feed the top sheet 1-a from the stack of sheets 1. Of the sheets moved leftwardly in the figure by a force of friction between the friction member 6 in pressing engagement with the supply roller 5 through a spring 13 and the supply roller 5, those which contact with the friction member 6 are interfered with and the top sheet 1-a alone, brought into contact with the pickup rollers 4 and supply roller 5, is moved toward the downstream side. As a result, the stack of sheets 1 are individually separated and transported by the pair of conveyor rollers 12, 12' to a subsequent processing station.

The pickup rollers 4 are supported by a shaft 14 connected through a belt 11 to a shaft 15. A clutch 16 is mounted between the shaft 15 and the motor 7 to remove the drive forces exerted on the shafts 14 and 15 at a point in time at which the top sheet 1-a is held between the conveyor rollers 12 and 12'. A guide member 17 for guiding the stack of sheets 1 piled on the sheet feed tray 3 is provided, and the friction member 6 projects from the guide member 17 into pressing engagement with the supply roller 5. invention.

Figure 3:
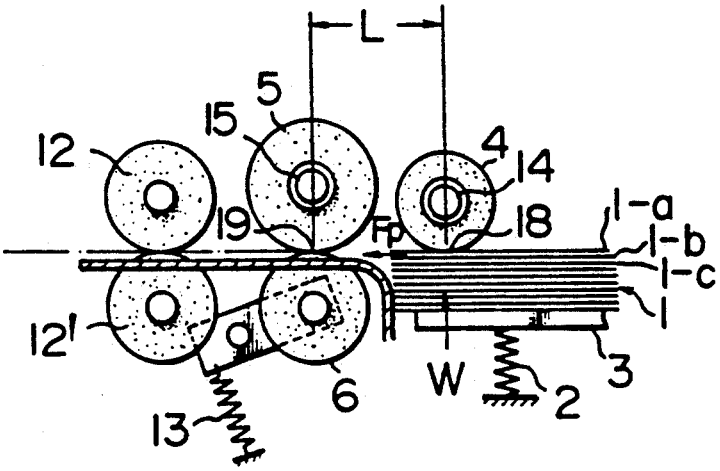
FIG. 3 is a vertical sectional view of portions of one embodiment of the sheet feeding device of the invention.

In the embodiment of FIG. 3, the point of contact between the pickup rollers 4 and the stack of sheets 1 or the point at which a feeding force is exerted on the uppermost sheet 1-a and the point of contact between the supply roller 5 and the friction member 6 or the point at which a separating force is exerted on the sheets fed by the pickup rollers 4 located downstream of the point at which the feeding force is exerted on the top sheet 1-a are separated by a distance L which is set at a level which causes no buckling to occur between the pickup rollers 4 and the separating means during the time the sheets are fed to the next processing station.

It has been experimentally determined that, when sheets thinner than 55 kg paper are handled, the distance L (mm) between the point at which a feeding force is exerted on the sheets and the point at which a separating force P (gf) is exerted on the sheets that have been fed should be in the range defined by the following formula (1) to avoid the buckling of the thin sheets of the ream weight K (kg):

$$L < 0.83\, K^{\frac{3}{2}} / \sqrt{P} \quad (1)$$

The following Euler's formula relating buckling of long columns is well known as a simple theoretical formula illuminating the buckling phenomenon:

$$P_k = n\pi^2 EI/L^2, \quad (2)$$

where:

$P_k$: buckling load;

E: modulus of longitudinal elasticity of column;

I: second moment of area of column;

L: length of column;

n: constant value relied upon support conditions of both ends of column;

Assuming that the formula is applied to the thin sheet, the buckling load $P_k$ corresponds to the feeding force P when buckling, the second moment of area of column I is equal to b $h^3/12$, where b is a width of the sheet and h is a thickness of the sheet, with the length of column L corresponding to the distance L shown in FIG. 3. Further, the thickness h of the sheet is assumed to be proportional to the ream weight K of the sheet. As a result:

$$P\text{-}K^3/L^2, \quad (3)$$

or $$L = AK^{\frac{3}{2}} / \sqrt{P}\,. \quad (4)$$

A constant value A is obtained experimentally. Namely, the constant value A is determined by making a buckling experiment with one condition of combination of (P, K, L).

Figure 4:
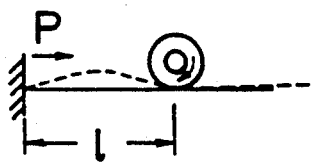
FIG. 4 is a schematic view showing a method for measuring a buckling characteristic of the sheets.
Figure 5:
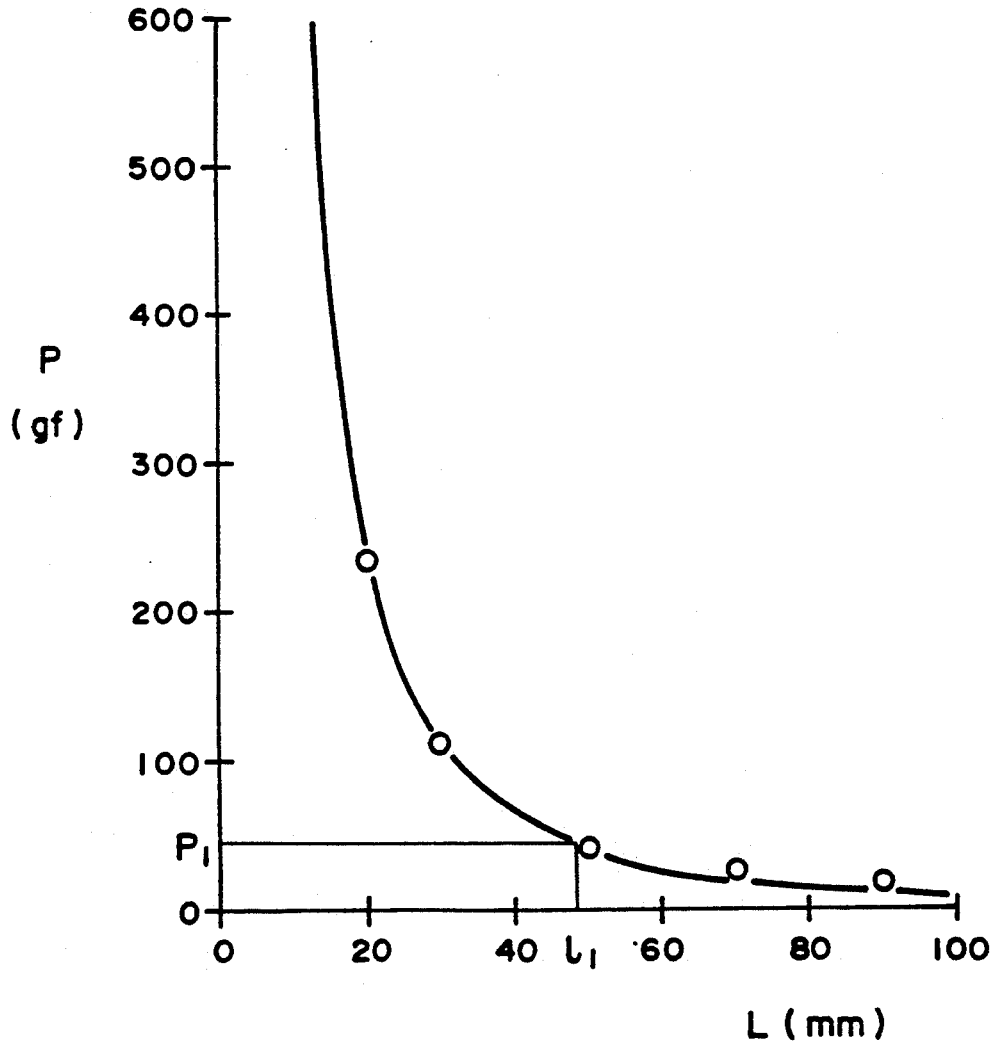
FIG. 5 is a graphical illustration of the buckling characteristic of a sheet of 55 kg in ream weight.

As shown in FIG. 4, a buckling reaction P is measured when the sheet in a solid line position is warped into a broken line position by exerting a force on a point spaced apart, by a distance (, from the leading end of a sheet of ream weight K. FIG. 5 shows results of the buckling experiments on the 55 kg paper, taking the distance L on abscissa and the buckling reaction P on ordinate.

When the result of the test described hereinabove is applied to the separation mechanism shown in FIG. 3, it will be seen that it is necessary to reduce the pressing force with which the sheet 1 is forced against the pickup rollers 4 and to shorten the distance L between the pickup rollers 4 and the supply roller 5 or the distance L between a point 18 at which feeding force is exerted on the sheet 1 and a point 19 at which a separating force is exerted on the sheet 1 that has been fed.

Referring to FIG. 5 again, it is possible to infinitely increase the value of ( by reducing the force with which a sheet is fed by the pickup rollers 4. In actual practice, however, to feed a sheet by the pickup rollers 4 from a stack of sheets by overcoming a force of friction $P_p$ acting between the sheets plus a force of friction R exerted by the friction member 6 on the leading end of the sheet, the device requires application of a force $P_F$ higher than a certain level ($P_f > P_p + R$).

The force of friction $P_p$ acting between the top sheet and the second sheet may vary depending on the thickness and size of the sheets. A sheet of 55 kg of a size A2 has a weight w of about 16 gf. The coefficient of friction $\mu p$ between the sheets is generally 0.1 to 0.6, which coefficient increases in the high humidity, now we assume that the coefficient of friction $\mu p$ has a maximum value of 1.0 to cause the calculation for design to be more safe. Accordingly, $P_p$ may be represented by $P_p = w \times \mu p = 16$ gf.

On the other hand, the sheets fed by the pickup rollers 4 move on the surface of the guide member 17 in sliding movement. However, when the sheets abut against the friction member 6, the force of friction R is exerted thereon to interfere with their movement if the force of friction R becomes larger than the buckling reaction P of the sheets, a jamming occurs.

The force of friction R is greatly influenced by the angle at which the sheets abut against the friction member 6 and the coefficient friction (0.6 to 1.2) between the sheets and the friction member 6. The angle at which the sheets abut against the friction member 6 is decided by the dimensions and configurations of the guide member 17 and the friction member 6. In actual practice, deformation of sheets, such as bending, exerts influences on the angle. Experiments were conducted to obtain an optimum maximum force of friction R and it was determined, when the sheet handled is of 55 kg paper, the maximum friction force R is preferably about 30 gf.

Thus, the force with which the sheets are fed by the pickup rollers or the feeding force $P_F$ is 46 gf and the buckling reaction P corresponding to the feed force $P_F$ has a lower limit.

More specifically, in FIG. 5, when the lower limit $P_1$ of the buckling reaction P is set at 46 gf, the value $l_1$ of the distance l is approximately 50 mm.

In principle, the smaller the buckling reaction $P_1$, the greater can be made the value $l_1$ of the distance l (corresponding to the distance L in the sheet separation mechanism shown in FIG. 3).

Referring to FIG. 3, it has been stated previously that the distance between the point 18 at which a feeding force is exerted on the sheet 1 by the pickup rollers 4 and the point 19 at which a separating force is exerted on the sheet 1 by the friction member 6 and the supply roller 5 is designated by L. It will be appreciated that, in view of the buckling characteristic of the sheet shown in FIG. 5, the higher the value of L, the more readily jamming of bending of the sheet occurs as a result of sheet buckling.

Assuming that the value of L has been decided, then an allowable maximum value of a pressing force W with which the sheet 1 is forced against the pickup rollers 4 can be decided.

Let the force (pressing force) with which the sheet 1 is forced against the pickup rollers 4 and the coefficient of friction between the sheets be denoted by W and $\mu p$, respectively. Then a feeding force would be exerted on the second sheet 1-b under the uppermost sheet 1 a by the force of friction acting between them. At this time, a force of friction opposed to the feeding force would be exerted on the underside of the second sheet 1-b because it is in contact with a third sheet 1-c below it. If the force of friction between any sheets remains constant at all times, the second sheet 1-b would be difficult to move. However, the coefficient of friction between the sheets does not remain constant because each sheet is differently processed at its upper- and undersides and a layer of air and/or bending or wrinkling exists between the sheets. Thus, the second sheet 1-b usually moves as the uppermost sheet 1-a is fed by the pickup rollers 4. If a frictional feeding force essentially exerted on the second sheet 1-b is denoted by $F_p$ ($\div \mu pW$), it would be evident, in view of the buckling characteristic shown in FIG. 5, that bending or jamming of sheets would result unless the condition $P > F_p$ is satisfied.

If the pressing force W were reduced, the frictional feeding force $F_p$ could be reduced and the condition $P > F_p$ could be satisfied. However, the value of L has a lower limit that is decided by design. Also, variations in the characteristic of the springs 2 for forcing the stack of sheets 1 against the pickup rollers 4 would occur. All things considered, it would be impossible to set the value of the pressing force W in the vicinity of zero, and there is, after all, an allowable minimum range for the values of allowable buckling reaction P.

When the value of the frictional feeding force $F_p$ decided by the characteristic of the sheets has been selected, it is possible to decide upon the allowable range of values for the pressing force W by the formula $W = F_p/\mu p$.

Figure 6:
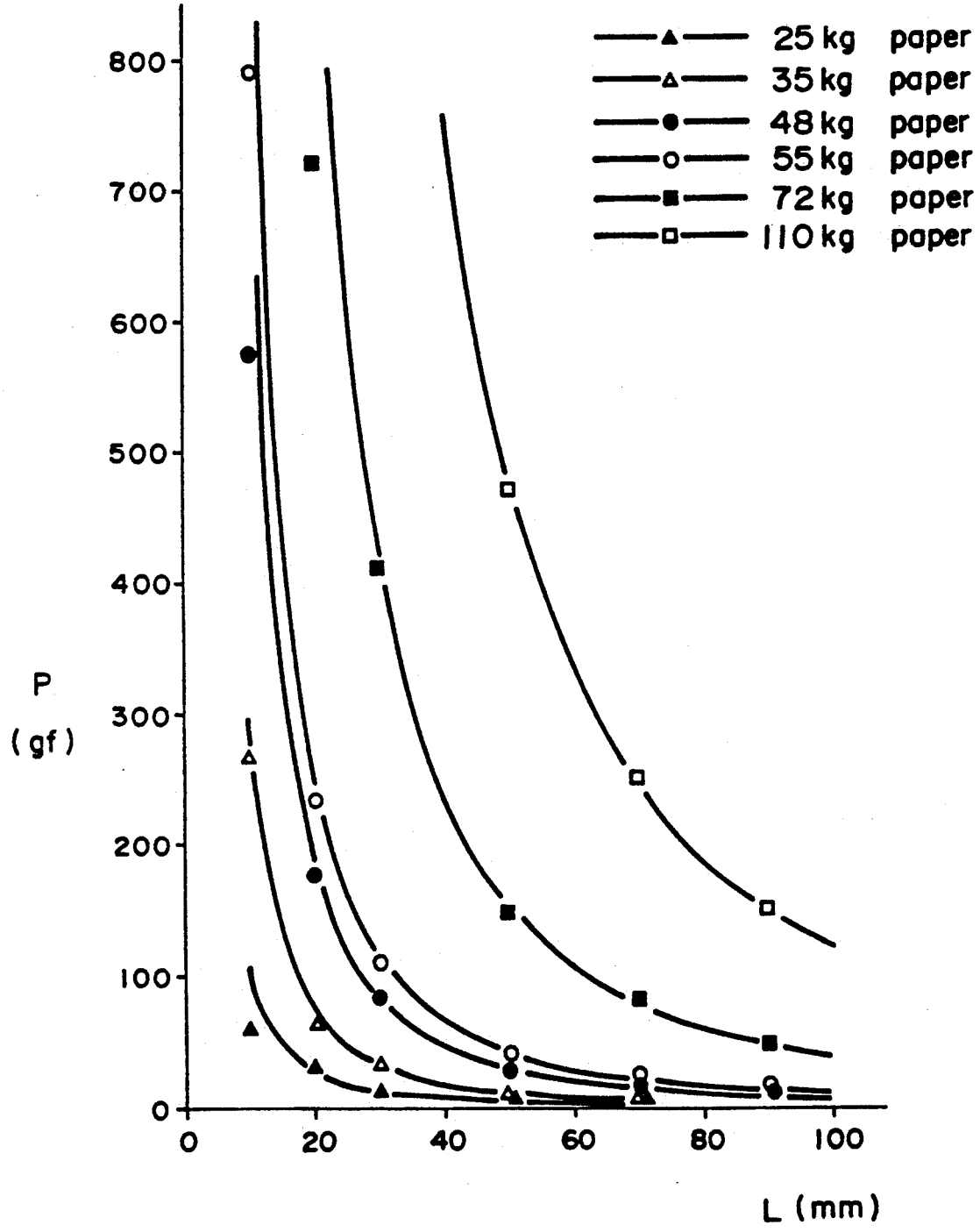
FIG. 6 is a graph showing the buckling characteristic of sheets of various ream weights.

FIG. 6 shows the results of experiments conducted on the buckling characteristic of sheets with regard to sheets of larger and smaller thicknesses than sheets of 55 kg paper which constituted the main objective of the experiments. The sheets serving as the objective of the experiments included those of 72 kg paper, 110 kg paper, 48 kg paper, 35 kg paper and 25 kg paper. In the diagram shown in FIG. 6, the abscissa represents the distance between the point at which the pickup rollers exert a feeding force on the sheets and the point at which the separating means exerts a separating force on the sheets, and the ordinate indicates the frictional feeding force $F_p$ at the beginning of the buckling phenomenon, i.e. the buckling reaction P.

Figure 7:
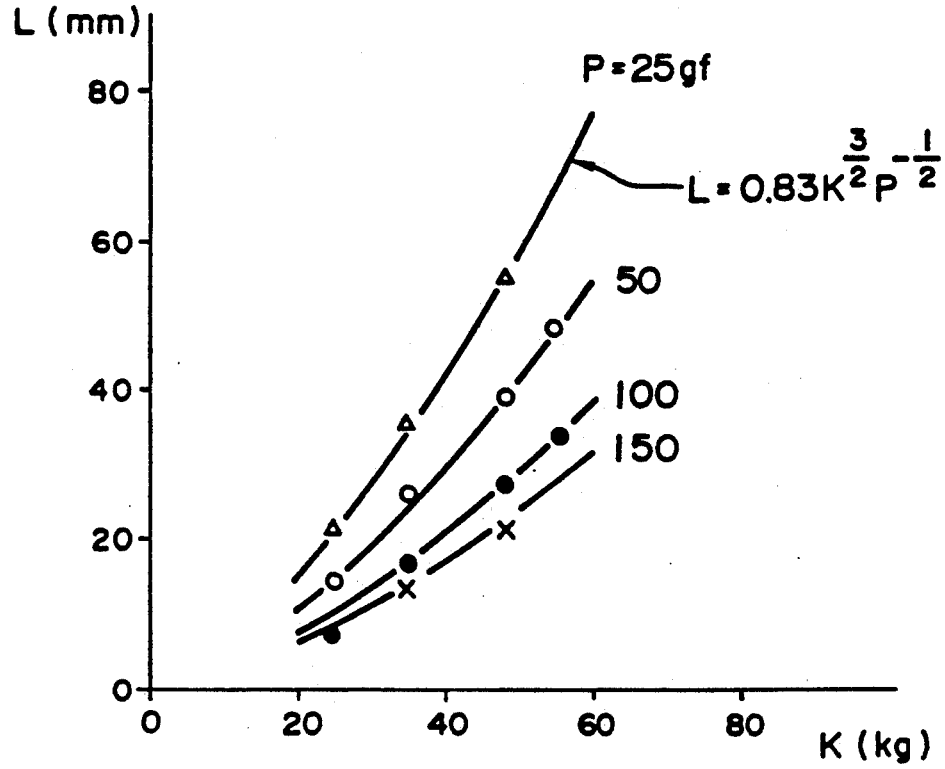
FIG. 7 is a graphical illustration of the buckling characteristic of the thin sheets with a parameter of the feeding force P.
Figure 8:
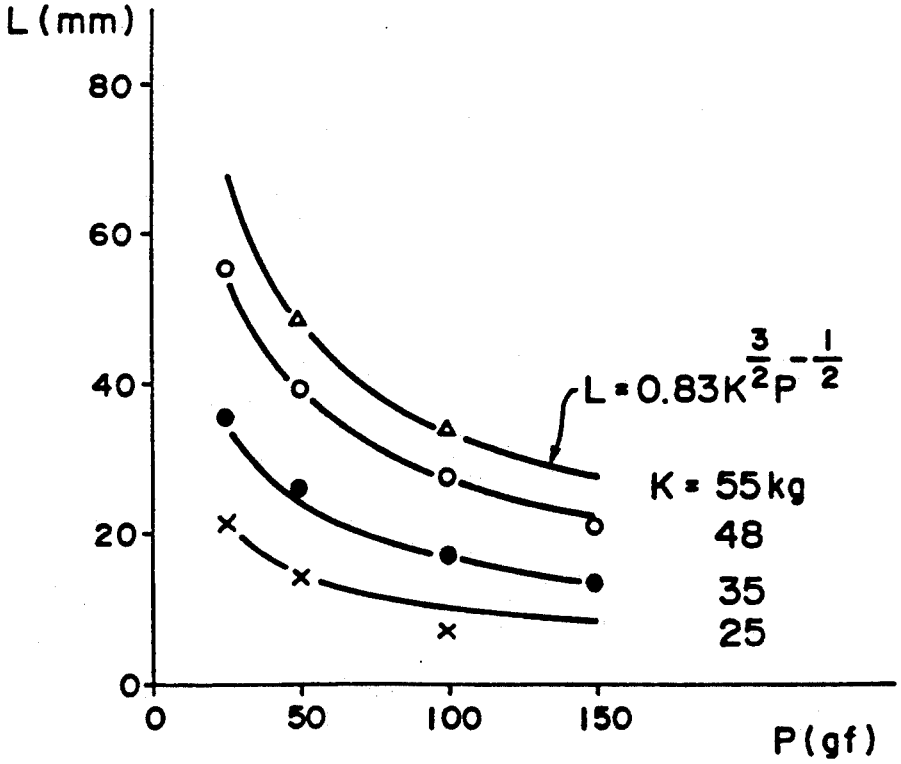
FIG. 8 is a graphical illustration of the buckling characteristic of the thin sheets with a parameter of the ream weight K.

FIG. 7 shows the buckling characteristic of the thin sheets of various ream weights, taking the ream weight K on abscissa and the distance L on ordinate with the buckling reaction P as a parameter. The buckling reaction P is selected near the practical minimum frictional feeding force (about 50 gf). Solid lines indicate the formula (4) with the constant value A being 0.83. Further, the experimental results are superposed on the solid lines. FIG. 8 shows the buckling characteristic of the thin sheets like FIG. 7, but taking the buckling reaction P on abscissa and the distance L on ordinate with the ream weight K as a parameter. As clearly shown in FIGS. 7 and 8, the experimental formula (5) below represents the buckling characteristic of the thin sheet well.

$$L = 0.83\, K^{\frac{3}{2}} / \sqrt{P} \tag{5}$$

If the distance L is set in the range defined by the formula (6) below with respect to given K and P, the thin sheet would be fed with no buckling.

$$L < 0.83\, K^{\frac{3}{2}} / \sqrt{P} \tag{6}$$

The sheet feeding device according to the present invention comprises a plurality of pickup rollers for feeding the thin sheets. Namely, the embodiment shown in FIG. 2 has two pickup rollers 4. The pickup rollers 4 are apart from each other in a direction perpendicular to the sheet feeding direction and arranged both sides of and separated, by the same distance, from a line passing through the separating means 5, 6 and is parallel to the sheet feeding direction.

Figure 9:
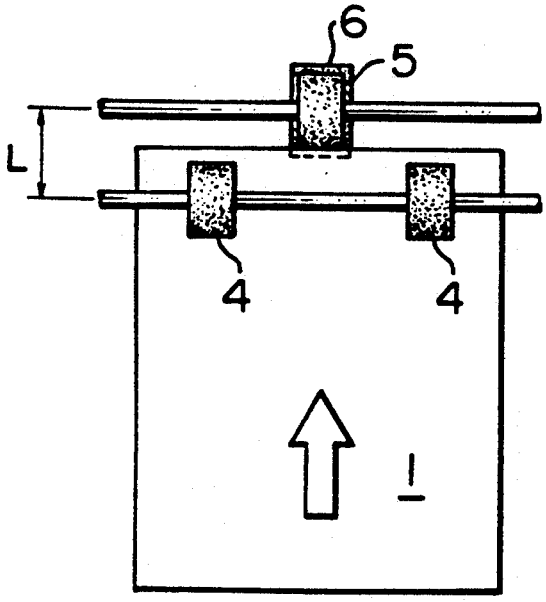
FIG. 9 is a schematic plan view, of a configuration of the pickup rollers and the separating means of the embodiment shown in FIG. 2.
Figure 10:
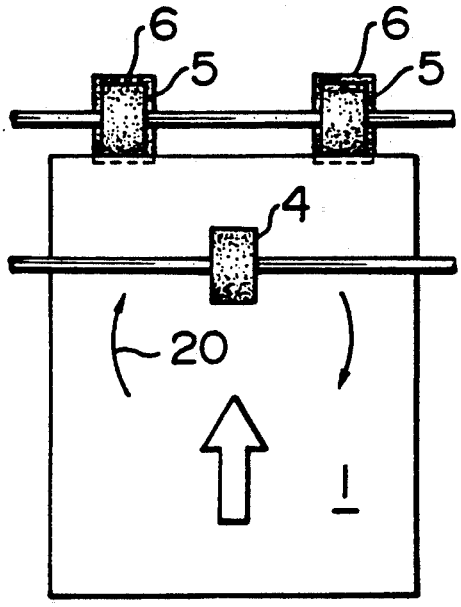
FIG. 10 PRIOR ART
FIG. 10 is a schematic plan view, analogous to FIG. 9, of a prior at sheet feeding device.

FIG. 9 shows the configuration of the pickup rollers 4 and the separating means 5, 6 of the embodiment shown in FIG. 2, while FIG. 10 shows the configuration of the prior art. If the configuration shown in FIG. 10 is used for feeding the thin sheets 1, the thin sheet would be easily subjected to bending near its leading end and a skew movement as shown by arrows 20 in FIG. 10. The skew movement is caused by a rotary moment which is produced by the action of the feeding force and the frictional force between the sheets. The sheets become thinner, these phenomena appear with higher possibility. In contrast, using the configuration shown in FIG. 9, the thin sheet 1 is restricted by the pickup rollers 4 at two points, thus the sheet bending and the skew movement are hardly produced.

Figure 11:
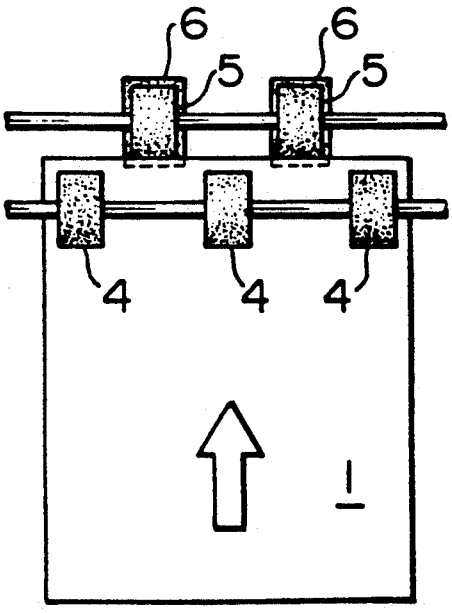
FIG. 11 is a schematic plan view, analogous to FIG. 9, of another embodiment of the invention.

FIG. 11 shows another embodiment with another configuration including three pickup rollers 4 and two sets of the separating means 5, 6.

Figure 12:
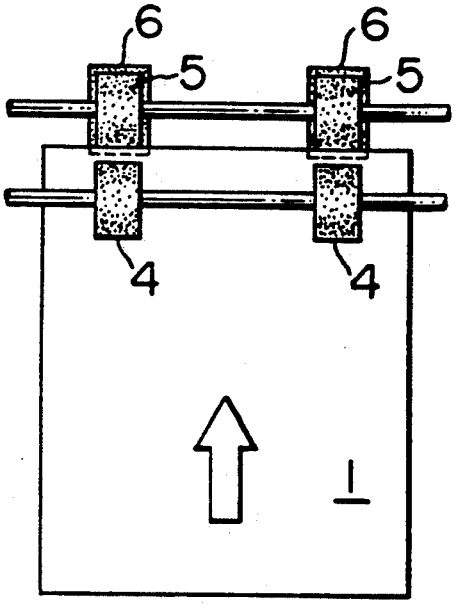
FIG. 12 is a schematic plan view, analogous to FIG. 9, of further another embodiment of the invention.

FIG. 12 shows further another embodiment with further another configuration including two pickup rollers 4 each facing a set of the separating means 5, 6.

Figure 13:
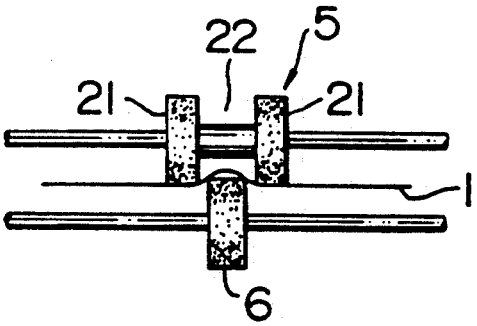
FIG. 13 is a front view of a modified separating means.

FIG. 13 shows modified separating means including a modified supply roller 5 and a friction roller 6. The modified supply roller 5 has two parallel wheels 21 defining a space 22 therebetween. The friction roller 6 is arranged to face the space 22 and overlap with the wheels 21 in a direction perpendicular to the sheet 1.

In the foregoing description, the pickup rollers have been described as being in the form of friction rollers. It is to be understood, however, that the invention is not limited to this specific form of feeding means and that the feeding means may be vacuum drawing means.

From the foregoing description, it will be appreciated that the sheet feeding device according to the invention enables one thin sheet at a time to be fed by accurately separating them without the trouble of sheet bending or jamming occurring. The invention enables the sheets of a thickness less than 55 kg paper to be used in offices which have previously been difficult to handle by terminal equipment of office automation apparatus including OCR and printers. Thus, the invention enables a like conservation of raw materials, reduction in paper costs for users and reduction in space required for storing sheets.

What is claimed is:

1. A sheet feeding device for separating one sheet of a ream weight of 55 kg or less at a time from a stack of sheets stacked on a sheet feed tray and for feeding the sheet to a next processing station, comprising:

feeding means for exerting a feeding force P (gf) on surfaces of sheets stacked on the sheet feed tray, said feeding means comprising at least one rotary feeding member; and separating means for offering resistance to the sheets fed by the feeding means, said separating means including at least one rotary supply member and an associated friction member in pressing contact with each other for applying a frictional force the sheets wherein a distance L (mm), in a sheet feeding direction, between a point at which feeding means exerts the feeding force on the sheets and a point at which the separating means exerts at separating force on the sheets is less than:

$$A K^{3/2}/\sqrt{P}$$

where:

A is a constant and K is a ream weight of the sheets and is defined by a weight (kgf) of a thousand sheets of sizes 788 mm×1091 mm.

2. A sheet feeding device for separating sheets having a ream weight of no more than about 55 kg and being stacked in a first position on a feed tray for feeding a separated sheet in a direction toward a second position, comprising:

means for feeding a sheet from a stack of sheets in the first position by exerting a force, P (gf) on surfaces of sheets of the stack, including at least two rotary feeding members spaced from each other in a direction perpendicular to the feeding direction; and means for separating each sheet from the other sheets by offering resistance to each sheet at a location which is closer to the second position than is the feeding means, wherein the separating means comprises at least one rotary supply member and at least one friction member in pressing contact with each other for applying a frictional force on each sheet, and the rotary supply member and friction member being located not outside boundaries defined in the feeding direction by the spaced rotary feeding members wherein a distance L (mm), in a sheet feeding direction between a point at which the feeding means exerts the feeding force on the sheets and a point at which the separating means exerts a separating force on the sheets is less than:

$$A K^{3/2}/\sqrt{P}$$

where:

A is a constant and K is a ream weight of the sheet and is defined by a weight (kgf) of a thousand sheets of sizes 788 mm×1091 mm.

3. A sheet feeding device for separating one very thin sheet at a time from a stack of very thin sheets piled on a sheet feed tray and feeding same to a next processing station, comprising:

rotary feeding means for exerting a feeding force on one or more of the sheets piled on the sheet feed tray;

pressing means for forcing the stack of sheets piled on the sheet feed tray in relation to the rotary feeding means;

separating means for offering a reaction force to the sheets fed by the rotary feeding means;

wherein a distance L (mm), in a sheet feeding direction, between a point at which the feeding means exerts the feeding force on the sheets and a point at which the separating means exerts, a separating force on the sheets is less than:

$$A K^{3/2}/\sqrt{P}$$

where:

A is a constant, K is a ream weight of the sheet and is defined by a weight (kgf) of a thousand sheets of sizes 788 mm×1091 mm, and P is a frictional feeding force acting between an uppermost sheet and a second sheet of the stack pressed by said pressing means.

4. A sheet feeding device for separating one sheet at a time from a stack of sheets having a ream weight of no more than 55 kg piled on a sheet feed tray and feeding same to a next processing station, comprising:

rotary feeding means for exerting a feeding force on the stack of the sheets piled on the sheet feed tray;

pressing means for forcing the stack of sheets piled on the sheet feed tray relative to the rotary feeding means;

separating means for offering a reaction force to the sheets fed by the feeding means;

wherein a pressing force W exerted by the pressing means has the following relationship:

$$W = F_p/\mu p$$

where, $F_p$ designates a frictional feeding force acting between adjacent sheets of the stack pressed by said pressing means and $\mu p$ designates a coefficient of friction between the adjacent sheets, and wherein a distance L (mm), in a sheet feeding direction, between a point at which the feeding means exerts the feeding force on the sheets and a point at which the separating means exerts a separating force on the sheets is less, than:

$$A K^{3/2}/\sqrt{P}$$

where:

A is a constant, K is a ream weight of the sheet and is defined by a weight (kgf) of a thousand sheets of sizes 788 mm×1091 mm, and P is said frictional feeding force $F_p$ acting between the adjacent sheets.

5. A sheet feeding method, comprising the steps of:

(a) stacking very thin sheets on a sheet feeding tray;

(b) exerting a feeding force P on a surface of at least one of the sheets to feed each of the sheets one at a time from the tray in a sheet feeding direction;

(c) separating each of the sheets by exerting a separating force which offers resistance to the sheets being fed in the sheet feeding direction at a distance from a point at which the feeding force is exerted of less than $$A K^{3/2}/\sqrt{P},$$

wherein A is a constant and K is a ream weight of the sheets and is defined by a weight (kgf) of a thousand sheets of sizes 788 mm×1091 mm; and (d) feeding each of the separated sheets to another location.

6. A sheet feeding device for separating one very thin sheet at a time from a stack of very thin sheets piled on a sheet feed tray and feeding same to a next processing station, comprising:

rotary feeding means for exerting a feeding force on one or more of the sheets piled on the sheets feed tray;

pressing means for forcing the stack of sheets piled on the sheet feed tray against the rotary feeding means;

separating means for offering a reaction force to the sheets fed by the rotary feeding means;

wherein a distance L (mm), in a sheet feeding direction, between a point at which the feeding means exerts the feeding force on the sheets and a point at which the separating means exerts a force on the sheets is less than:

$$A K^{3/2}/\sqrt{P}$$

A is a constant, and K is a ream weight of the sheet and is defined by a weight (kgf) of a thousand sheets of sizes 788 mm×1091 mm, and P is a frictional feeding force acting between an uppermost sheet and a second sheet of the stack pressed by said pressing means, and the pressing means exerts a force on the stack at a position substantially the same as a level defined by a line between where the feeding force and the reaction force are applied to the sheets.

7. A sheet feeding device for separating one sheet at a time from a stack of sheets having a ream weight of no more than 55 kg piled on a sheet feed tray and feeding same to a next processing station, comprising:

rotary feeding means for exerting a feeding force on the stack of the sheets piled on the sheet feed tray;

pressing means for forcing the stack of sheets piled on the sheet feed tray against the rotary feeding means;

separating means for offering a reaction force to the sheets fed by the feeding means;

wherein a pressing force W exerted by the pressing means has the following relationship:

$$W = F_p/\mu p$$

where, $F_p$ designates a frictional feeding force acting between adjacent sheets of the stack pressed by said pressing means and $\mu p$ designates a coefficient of friction between the adjacent sheets, and wherein a distance L (mm), in a sheet feeding direction, between a point at which the feeding means exerts the feeding force on the sheets and a point at which the separating means exerts a separating force on the sheets is less than:

$$A K^{3/2}/\sqrt{P}$$

where:

A is a constant, and K is a ream weight of the sheet and is defined by a weight (kgf) of a thousand sheets of sizes 788 mm×1091 mm, and P is said frictional feeding force $F_p$ acting between the adjacent sheets, and the pressing force exerted by the pressing means is at a position substantially the same as a level defined by a line between where the feeding force and the reaction force are applied to the sheets.

8. A sheet feeding device for separating one sheet of a ream weight of 55 kg or less at a time from a stack of sheets on a sheet feed tray and for feeding the sheet to a next processing station, comprising:

at least one rotary feeding member for exerting a feeding force (gf) on a surface of one or more sheets of the stack of sheets stacked on the sheet feed tray;

at least one rotary supply member and an associated friction member for exerting a friction force on the sheets fed by the at least one rotary feeding member;

pressing means for forcing the stack of sheets piled on the sheet feed tray against the rotary feeding member with a force W having the relationship $F_p/\mu p$, where $F_p$ designates a frictional feeding force acting between adjacent sheets of the stack pressed by said pressing means and $\mu p$ designates a coefficient of friction between the adjacent sheets, wherein a distance L (mm), in a sheet feeding direction, between a point at which the at least one rotary feeding member exerts the feeding force on the sheets and a point at which the at least one supply member and associated friction member exerts the friction force on the sheets is less than:

$$A K^{3/2}/\sqrt{P}$$

where:

A is a constant, K is a ream weight of the sheet and is defined by a weight (kgf) of a thousand sheets of sizes 788 mm×1091 mm, and P is the feeding force on surfaces of the sheets stacked, on the sheet feed tray.

9. A sheet feeding device for separating one sheet of a ream weight of 55 kg or less at a time from a stack of sheets on a sheet feed tray and for feeding the sheet to a next processing station, comprising:

at least one rotary feeding member for exerting a feeding force (gf) on a surface of one or more sheets of the stack of sheets stacked on the sheet feed tray;

at least one rotary supply member and an associated friction member in pressing contact with each other for exerting a friction force on the sheets fed by the at least one rotary feeding member; the pressing means for forcing the stack of sheets piled on sheet feed tray against the rotary member at a level defined substantially by a line between where the feeding force and the friction force are applied to the sheets, with a force W having the relationship $F_p/\mu p$, where $F_p$ designates a frictional feeding force acting between adjacent sheets of the stack pressed by said pressing means and yp designates a coefficient of friction between the sheets, wherein a distance L (mm), in a sheet feeding direction, between a point at which the at least one rotary feeding member exerts the feeding force on the sheets and a point at which the at least one supply member and associated friction member exerts the friction force on the sheets is less than:

$$A K^{3/2}/\sqrt{P}$$

where:

A is a constant, K is a ream weight of the sheet and is defined by a weight (kgf) of a thousand sheets of sizes 788 mm×1091 mm, and P is the feeding force on surfaces of the sheets stacked on the sheet feed tray.

10. A sheet feeding device for separating one sheet of a ream weight of 55 kg or less at a time from a stack of sheets stacked on a sheet feed tray and for feeding the sheet to a next processing station, comprising:

a plurality of rotary feeding members for exerting a feeding force (gf) on a surface of one or more sheets of the stack of sheets stacked on the sheet feed tray;

at least one rotary supply member and an associated friction member in pressing contact with each other for exerting a friction force on the sheets fed by the at least one rotary feeding member;

pressing means for forcing the stack of sheets piled on the sheet feed tray against the rotary feeding member at a level defined substantially by a line between where the feeding force and the friction force are applied to the sheets;

wherein a distance L (mm), in a sheet feeding direction, between a point at which the at least one rotary feeding member exerts the feeding force on the sheets and a point at which the at least one supply member and associated friction member exerts the friction force on the sheets is less than:

$$A K^{3/2} / \sqrt{P}$$

where:

A is a constant, K is a ream weight of the sheet and is defined by a weight (kgf) of a thousand sheets of sizes 788 mm × 1091 mm, and P is the feeding force on surfaces of the sheets stacked on the sheet feed tray.

11. A sheet feeding device for separating one sheet of a ream weight of 55 kg or less at a time from a stack of sheets on a sheet feed tray and for feeding the sheet to a next processing station, comprising:

at least one feeding member for exerting a feeding force (gf) on a surface of one or more sheets of the stack of sheets stacked on the sheet feed tray;

at least one rotary supply member equal in number to and aligned with the at least one feeding member and associated friction member in pressing contact with each other for exerting a friction force on the sheets fed by the at least one rotary feeding member;

pressing means for forcing the stack of sheets piled on the sheet feed tray against the rotary member at a level defined substantially by a line between where the feeding force and the friction force are applied, with a force W having the relationship $F_p/\mu p$ where $F_p$ designates a frictional feeding force acting between adjacent sheets of the stacked pressed by said pressing means and $\mu p$ designates a coefficient of friction between the sheet, wherein a distance L (mm), in a sheet feeding direction, between a point at which the at least one rotary feeding member exerts the feeding force on the sheets and a point at which the at least one supply member and associated friction member exerts the friction force on the sheets is less than $$A K^{3/2} / \sqrt{P}$$

where:

A is a constant, K is a ream weight of the sheet and is defined by a weight (kgf) of a thousand sheets of sizes 788 mm × 1091 mm, and P is the feeding force on surfaces of the sheets stacked on the sheet feed tray.

* * * * *